US006401263B2

(12) United States Patent
Chang

(10) Patent No.: US 6,401,263 B2
(45) Date of Patent: Jun. 11, 2002

(54) PORTABLE URINAL APPARATUS

(76) Inventor: Edward T. Chang, 2107 Winterwood Dr., Fullerton, CA (US) 92833

( * ) Notice: Subject to any disclaimer, the term of this patent is extended or adjusted under 35 U.S.C. 154(b) by 0 days.

(21) Appl. No.: 09/847,986

(22) Filed: May 1, 2001

Related U.S. Application Data

(63) Continuation-in-part of application No. 09/267,433, filed on Mar. 12, 1999, now abandoned.

(51) Int. Cl.[7] ..... A47K 11/12
(52) U.S. Cl. ..... 4/144.1; 4/300.3
(58) Field of Search ..... 4/144.1, 144.4, 4/310, 311, 300.3

(56) References Cited

U.S. PATENT DOCUMENTS 211,078 A * 1/1879 Adee ..... 4/311
4,282,611 A * 8/1981 O'Day ..... 4/144.1
4,612,676 A * 9/1986 Whitman ..... 4/300.3
5,450,632 A * 9/1995 Esswein et al. ..... 4/144.1

* cited by examiner

*Primary Examiner*—Robert M. Fetsuga
(74) *Attorney, Agent, or Firm*—Raymond Y. Chan; David and Raymond Patent Group

(57) ABSTRACT

A portable urinal apparatus includes a supporter attached to the top of a catch basin and a discharge tube attached to the bottom of the catch basin, in which the catch basin is constructed so as to catch urinary fluids and direct those fluids down through the discharge tube into the toilet bowl of a conventional sit down toilet. An interior chamber is defined by the walls of the catch basin. The sides of the catch basin are sloped to direct fluids towards the middle and bottom of the interior chamber of the catch basin, rather than outside the basin. The bottom of the catch basin is sloped to direct fluids towards the discharge tube. When in use, the bottom end of the discharge tube is positioned over the middle area of the toilet bowl.

12 Claims, 5 Drawing Sheets

PORTABLE URINAL APPARATUS

CROSS REFERENCE OF RELATED APPLICATIONS

This is a Continuation-In-Part application of a non-provisional application, application Ser. No. 09/267,433, filed on Mar. 12, 1999 abandoned.

DESCRIPTION OF RELATED ARTS

Background of the Present Invention

1. Field of the Present Invention

The present invention relates to a portable urinal apparatus, and more particularly to a portable unisex urinal apparatus for directing an individual's urinary waste matters into a toilet bowl allowing the individual to remain standing while avoiding contact with the toilet, and reducing the incidence of spillage on the outer surface of the toilet or the surrounding area.

2. Description of Related Arts

No one likes cleaning a bathroom used by men, especially in and around a toilet. That is because often, when a man urinates, he may miss the toilet bowl, hitting the toilet seat or around the toilet. Similarly, a man intending to urinate while standing, while using a traditional toilet, may not raise the toilet seat before urinating because he has a physical handicap preventing him from bending over, thus leading to spillage on the seat.

A boy or a man waking up in the middle of the night to use the bathroom may be too sleepy, and may not be paying attention and miss. Or, he may remember to lift the toilet seat before using the toilet in the bathroom, but forget to put it back down, causing him great embarrassment when his mother or wife comes in later to use the restroom in a similarly groggy state, and falls in the toilet.

In public restrooms, both men and women would prefer not to touch the toilet when they urinate for fear of germs. This is especially true when they notice drops of liquid on the seats. For men using a traditional toilet, if they urinate while standing, again, this may result in spillage on the toilet, further dissuading others from touching the toilet. For women, fear of touching a public toilet results in their discomfort as they are forced to squat over the toilet while trying to avoid touching it. Similarly, this may create a risk of missing the toilet bowl, and further contaminating the toilet seat, and again, dissuading others from using the seat. For either men or women, a dirty seat cover may prevent either of them from sitting down on the toilet seat and adding to their discomfort.

Commercially, small companies cannot always afford to have urinals and toilets to prevent this problem. In many instances, each bathroom has only one traditional toilet, and in an especially small establishment, there may be only one toilet for both men and women. Thus, the problem of a dirty toilet seat cover is not only important, but also very common.

Also, as a result of these misses and near misses, in both public and private restrooms, cleaning not only becomes more difficult, but undesirable for those who clean. In a private setting, this may lead to increased germs and risk to family members. In a public setting, this may lead to local health code violations resulting in possible fines, closures and, at the very least, negative publicity. In society, an apparatus has been needed that is an economical and convenient way of converting a traditional toilet to a urinal without requiring extra effort on the user of the toilet, or extra expense for the provider to provide a consistently clean, and convenient bathroom facility.

Furthermore, there is a common headache happened when he needs to go to the bathroom in the midnight for nearly every middle-age man. Most men, especially after 40 years old, need to wake up in the midnight to clear their bladders. Due to the fact that most men' penis are in the erect condition while sleeping in the midnight, especially when he has a full bladder of urine, it is not only very troublesome for one to walk to the bathroom in the middle of his sleeping, but also difficult to precisely deliver his urine into the toilet bowl. It is because the urethra opening of an erect penis is pointing upwards and the toilet bowl is positioned below the male sex organ. Every normal male, including children and adult, should have the experience of the difficulty of aiming the toilet bowl with his erect penis. It is painful and may hurt you if you try to push down your erect penis to aim at the toilet bowl. In fact, it is a quite embarrassing fact that no matter how he tries hard, it is still nearly impossible for him to prevent spilling his urine around the toilet.

U.S. Pat. No. 5,450,632, issued to Esswein et al, describes a standing urinal including an upper mouth piece which can engage both male and female users and has a handle, an intermediate urine container in the form of an elongated tube with volumetric graduations and a plugged lower end, and a lower telescopic leg having a rubber stopper at the bottom end for frictionally engaging a support surface, wherein the main object of Esswein et al is to provide a standing urinal primarily which would be used by a seated or standing individual while urinating and which is essentially self-supporting, or standing, and not needing to be held.

Moreover, U.S. Pat. No. 485,960, issued to Martin et al, suggests a water closet attachment having a top opening, U.S. Pat. No. 5,040,248, issued to Kelly, teaches a stand up training potty female toddlers which does not have a urinal bowl to collect the toddler's urine at all, and U.S. Pat. No. 3,742,953, issued to Lee, describes a disposable male urinary incontinence device for wrapping up the male penis completely.

Since the '632 patent is designed to be used by a seating or standing individual without the need of being held by the individual, it merely provides an upper mouth piece with a top opening for the user to directly place his penis above the mouth piece and urinate therein. Although an addition deflection hood can be detachably attached on the mouth piece as shown in FIG. 6 thereof, it still needs to leave a top inlet mouth opened on top of the mouth piece so that the user can downwardly drop his urine therethrough into the mouth piece. Since the '632 patent standing urinal is merely designed for patients who are not convenience to go to the restroom and use the toilet bowl so that they can urinate while seating or standing near their beds, the diameter of the mouth piece or the top inlet mouth is much smaller than the toilet bowl. Therefore, every male child or adult may still have the problem of aiming the relatively small top opening or top inlet mouth of the standing urinal of the cited art. Of course, how to prevent splashing and spilling around the urinal during urination is not the main concern of the '632 patent.

In other words, the '632 patent is used for collecting urine wherein the user's non-erected hanging down penis is all right to aim at the mouth thereof and deliver his urine into the container. However, when a male person urinates with a full bladder of urine when his penis usually is semi or fully erected, the erect penis normally has a length up to five or more inches long and a diameter up to 1 and a half inches. Moreover, his shooting angle is between 45 degree downward and 45 degree upward and his shooting speed is very strong too. To focus urinating into a portable urinal apparatus has to be easier than to focus into a regular toilet bowl, otherwise people will not bother to use it in the restroom. Practically, it is impossible for an erect penis to completely deliver all the discharged urine into the container as suggested in the '632 patent.

Also, the diameter of the top opening of the '960 patent must be much smaller than a toilet bowl. If a man or a kid has the problem of spilling and splashing all over the regular toilet bowl, Martin et al is totally helpless to a male who want to urinating with a full bladder and erected penis.

Besides, both Lee and Kelly are only designed for a patient to urinate while lying on bed by inserting the entire penis into a tubular thin rubber sheath or condom. It is not suitable to be used in bathroom so that it fails to prevent splashing and spilling around the urinal during urination in the bathroom.

SUMMARY OF THE PRESENT INVENTION

The main object of the present invention is to provide a portable urinal apparatus for converting any conventional toilet to a urinal, keeping the toilet and its surroundings clean by limiting errant discharges of urinating men.

Another object of the present invention is to provide a portable urinal apparatus which provides a catch basin having a wide side urinal opening at one side of the catch basin to enable the user to place his erect penis into the interior chamber thereof. The catch basin of the instant invention can easily and efficiently absorb the urine thrust impact when the user is urinating out a strong jet without any splashes and spilling. It is especially useful at night when the user is waked up by the strong urgent need that his penis is generally half or fully erected upwards. It is almost impossible to aim downwardly to the toilet bowl. However, the user can easily insert his erected glans penis in the interior chamber of the catch basin and urinate without the worry of aiming the toilet bowl or splashing and spilling all over the toilet bowl.

Another object of the present invention is to provide a portable urinal apparatus that allows a business to use a conventional toilet as a urinal, thus allowing the business to save the cost of having a urinal and toilet.

Another object of the present invention is to provide a portable urinal apparatus to aid small children in their use of the toilet and avoid errant discharges on and around the toilet.

Another object of the present invention is to provide a portable urinal apparatus for aiding men and women who cannot bend down to sit down or lift the toilet seat a way of urinating without creating a mess on or around the toilet.

Lastly, another object of the present invention is to provide a portable unisex urinal apparatus for allowing a woman to use a conventional toilet without having to sit on it or squat over it.

In order to accomplish the above objects, the present invention provides a portable unisex urinal apparatus, which comprises:

a catch basin defining an interior chamber, having an urinal opening on a side adapted to allow an individual to urinate into the catch basin, a outlet opening on bottom of the catch basin for the exit of any fluids in the catch basin, and the bottom of the interior chamber sloping downward towards the outlet opening;

a supporter integrally connected to the top of the catch basin; and a discharge tube connected to the bottom of the catch basin, wherein the outlet opening of the catch basin aligns with the discharge tube for the removal of fluids from the catch basin to a toilet.

Moreover, the catch basin can be curved to reduce splashing from the urinating fluids. Also, the edge of the catch basin underlining the urinal opening can be made thicker to prevent spilling of any fluids.

In addition, the discharge tube alternately is attached directly to the side of the toilet bowl, or be adjustable in length to be used for various toilets, or for a single toilet. The interior surfaces of the catch basin and discharge tube can be further comprised of a slick coating material to allow fluids to slide easier within the catch basin and down the discharge tube.

The portable unisex urinal apparatus can further comprises a mounting apparatus for mounting the apparatus to a wall for easy swiveling over a toilet bowl for use, and against the wall when not in use. The apparatus may also be further comprised of a holder for supporting the freestanding apparatus, or for transporting the apparatus.

DETAILED DESCRIPTION OF THE PREFERRED EMBODIMENT

Figure 1:
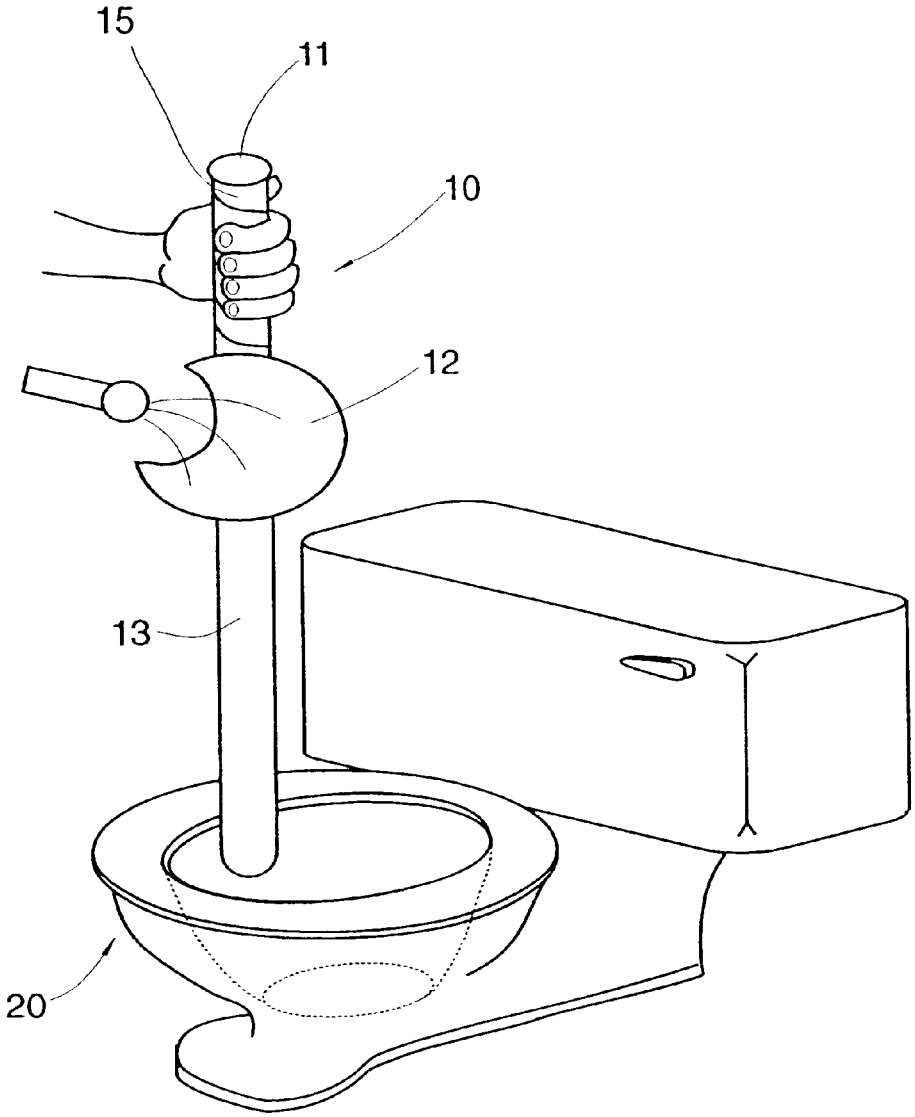
FIG. 1 is a perspective view of a portable urinal apparatus according to the first preferred embodiment of the present invention, demonstrating the apparatus in use.

Referring to FIGS. 1 to 4 of the drawings, a portable urinal apparatus 10 of the present invention is illustrated, which comprises an egg shaped hollow catch basin 12, a discharge tube 13 and a supporter 11.

The supporter 11 is integrally connected to a top of the catch basin 12. A discharge tube 13 downwardly extends from a base of the catch basin 12 for discharging fluids within the catch basin to a toilet 20. The catch basin 12 has a wide side urinal opening 121 for receiving fluids from urination, and an outlet opening 122 provided at the base of the catch basin 12 for communicating with the discharge tube 13, adapted for fluids to flow out of the catch basin 12 through the discharge tube 13 into the toilet 20 positioned below the discharge tube 13.

The interior surfaces of the catch basin 12 and the discharge tube 13 are preferred to be coated with a slick coating material to allow fluids to slide easier within the catch basin and down the discharge tube.

Figure 3:
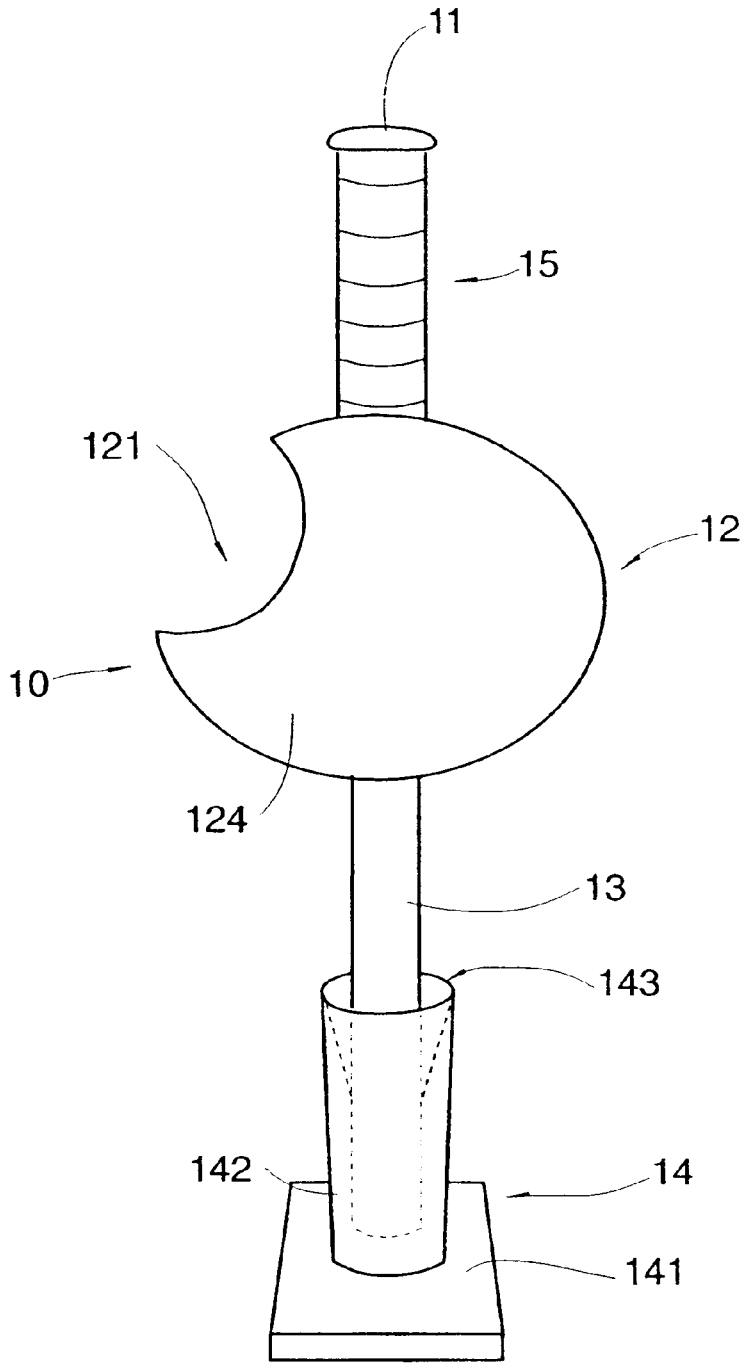
FIG. 3 is a side view of the portable urinal apparatus according to the above first preferred embodiment of the present invention, as it sits in a portable urinal storage unit.

According to the first preferred embodiment of the present invention, the catch basin 12 defines a semi enclosed interior chamber 123, which has a size larger than an adult's male sex organ and two openings formed on a front side and a bottom thereof respectively, which are the urinal opening 121 and the outlet opening 122. The urinal opening 121 is defined by the opening provide at one side of the catch basin 12. As shown in FIG. 3, the urinal opening is angled so as to form a lip 124 at the bottom of the urinal opening 121. The lip extends outwardly and away from the catch basin 12 so as to enlarge the catch area in the catch basin 12 that allows the catch basin 12 to catch any flows or dripping when the individual urinates.

The urinal opening 121 is made to have a height and a width of at least five inches or more, i.e. bigger than the size of an erect penis of an adult user, so as to enable the user to easily put his entire penis inside the interior chamber 123 through the urinal opening 121, even during the penis is in erect condition, so that the user can discharge his urine without any worry of splashing or spilling the toilet.

Moreover, the top and side walls of the catch basin 12 are curved so that even the urine discharged from an erect penis can also be reflected to splatter towards the inside of the chamber. Also, the bottom of said interior chamber 123 is sloped down towards the second hole 122 in bowl shape, and thus this sloping inward directs any liquid flowing into the chamber 123 to the middle of the chamber, rather than the sides, where it might splash out. The bottom of the interior chamber 123 is sloped towards the second hole 122 so that liquids will be drawn by gravity to flow into the discharge tube 13 and eventually into the toilet 20.

Figure 2:
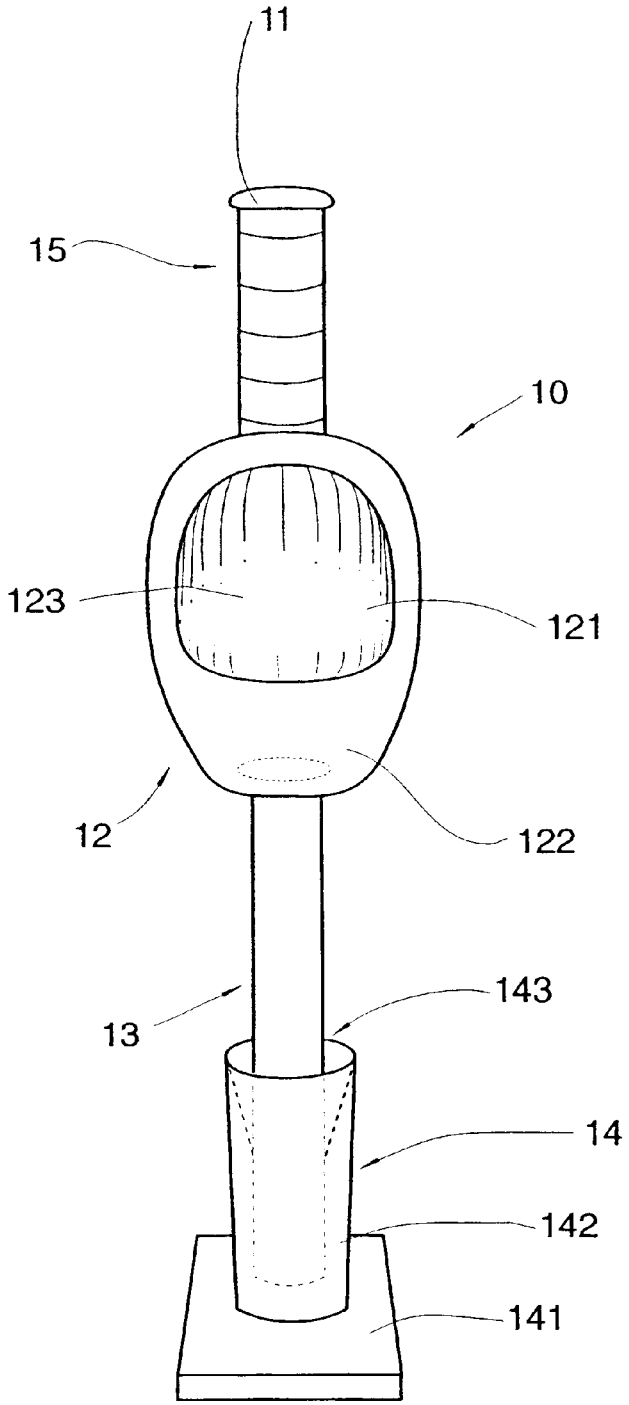
FIG. 2 is a front view of the portable urinal apparatus according to the above first preferred embodiment of the present invention, as it sits in a portable urinal storage unit.

The discharge tube 13 is integrally attached to the catch basin 12 at the second hole 122. The supporter 11 has a supporter wrap for a more secure hold when a person holds the apparatus 10. According to the first embodiment, as shown in FIGS. 1 to 3, the discharge tube 13 is a semi-rigid straight tube, such that the apparatus is lined up directly According to the first embodiment as shown in FIG. 1, as mentioned above, the size of the catch basin 12 and the its urinal opening 121 should be large enough for the user to place his entire penis in the interior chamber 123 via the wide side urinal opening 121, therefore when an individual uses the portable urinal apparatus 10, the individual holds the apparatus by the supporter 11, so that the discharge tube 13 is directly over the toilet 20. The supporter is covered by a cloth or rubber material so that the individual may easily hold the apparatus. The individual then urinates into the catch basin 12. The fluid then flows through the catch basin 12 down the discharge tube 13 to the toilet 20.

As shown in FIGS. 2 and 3, the portable urinal apparatus 10 may rest in a portable storage unit 14 when not in use. The portable storage unit 14 generally comprises a base 141 adapted to steadily stand on ground, and a holder 142 upwardly extended from the base 141. The holder 142 provides a vertical holding chamber 143 adapted for a bottom portion of the discharge tube 13 fittingly inserting therein so as to hold the portable urinal apparatus 10 in position when not in use.

None of the arts suggest any interior chamber 123 having the wide side urinal opening 121 provided on a front side and the outlet opening 122 provided on the bottom of the catch basin 12 for discharging fluids in the catch basin 12 and the following advantages substantially achieved by the portable urinal apparatus 10 of the present invention:

1. The catch basin 12 defines the semi enclosed interior chamber 123 and the urinal opening 121 is angled in such a manner that a bottom of the urinal opening 121 has a lip 124 extended outwardly and away from the catch basin to define a catch area adapted for allowing the catch basin 12 to catch any flows and dripping during urination.

2. The top and side walls of the catch basin 12 are curved for reflecting any fluid splattering towards an inside of the interior chamber 123 and a bottom of the interior chamber 123 is sloped down towards the outlet opening 122 in bowl shape, so as to direct any liquid flowing into the interior chamber to a middle of the interior chamber 123 rather than sides of the interior chambers 123 to prevent splashing out.

3. An user is capable of holding the portable urinal apparatus 10 by the supporter and placing the discharge tube 13 over a toilet while placing his penis in said interior chamber 123 via the wide side urinal opening 121 to urinate into the catch basin 12, so that urine flows through the catch basin 12 down the discharge tube 13 to the toilet.

Figure 4:
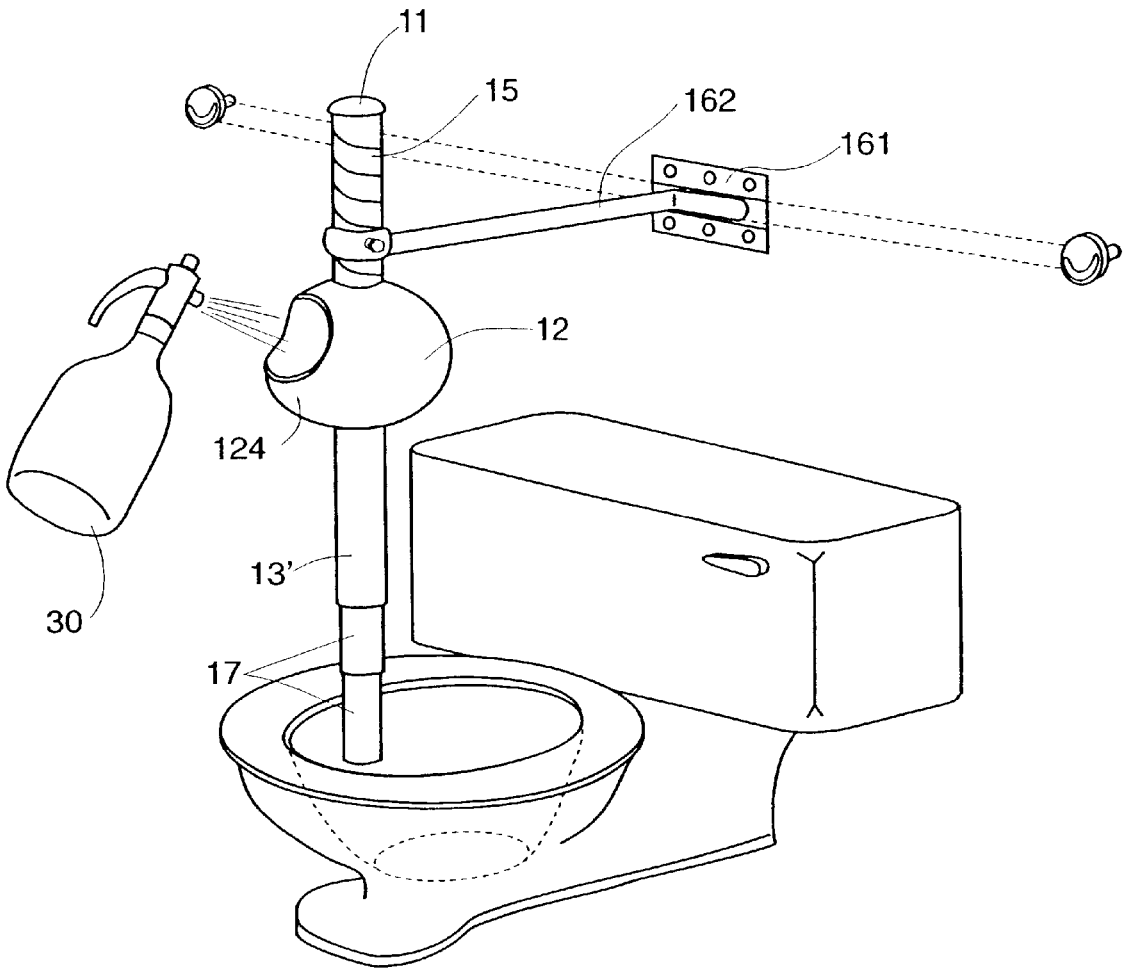
FIG. 4 is a perspective view of a portable urinal apparatus according to a second preferred embodiment of the present invention.

As shown in FIG. 4, a second embodiment, the portable urinal apparatus 10 is affixedly attached to the wall using a wall mounting apparatus. The wall mounting apparatus comprises a wall affixing mount 161 affixed at a predetermined height on a wall, and a swivel arm 162 having a first end pivotally connected to the wall affixing mount 161 and a second end secured to the supporter 11 of the portable unisex urinal apparatus. Accordingly, the swivel arm 162 may be swung away from the wall to move the apparatus 10 over the toilet 20 when the portable urinal apparatus 10 is in use. When it is not in use, the portable urinal apparatus 10 can be swung back to rest closed to the wall and away from the toilet 20.

As shown in the second embodiment in FIG. 4, the discharge tube 13' comprises a plurality of retractable sections 17 so as to allow the discharge tube 13' to be adjusted in height for different size toilets.

Figure 5:
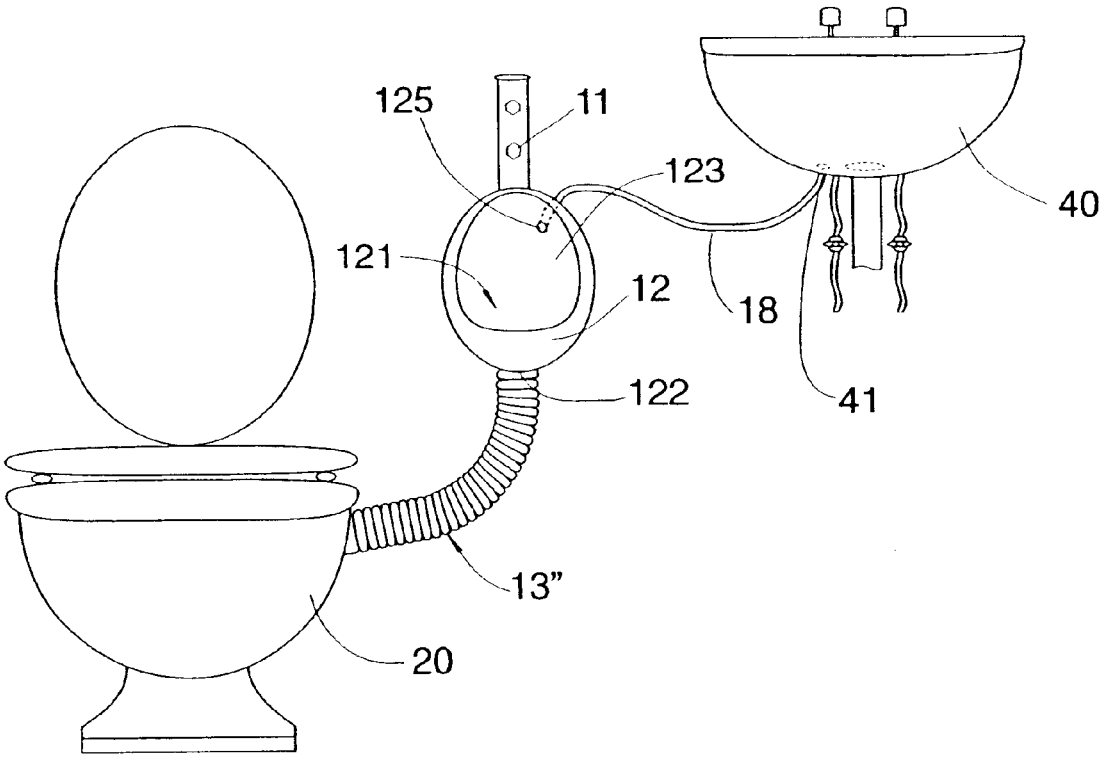
FIG. 5 is a front view of a portable urinal apparatus according to a third preferred embodiment of the present invention.

As shown in FIG. 5, a third embodiment of the present invention is illustrated, wherein the discharge tube 13" is alternatively constructed by a bendable tube that affixedly connects directly to a side of the toilet bowl 20, so that fluids may flow directly into that said toilet bowl 20. Besides, the supporter 11 can be a mount for affixing the portable urinal apparatus 10 on wall. The discharge tube 13" of the third embodiment can be bent and curved so that the portable urinal apparatus 10 may stand adjacent to the toilet. Moreover, the portable urinal apparatus 10 further comprises an additional cleansing duct 18 having one end connected to a faucet or a bottom outlet opening 41 of a hand washing sink 40, and another end connected to an inlet opening 125 provided at a top portion of the catch basin 12. Therefore, after the user discharges urine in the catch basin 12 and washes his hands at the adjacent hand washing sink 40, the hand washing water will discharge to wash the inside of the catch basin 12 too. Such arrangement creates a secondary usage for the hand washing water.

It is obvious that the retractable discharge tube 16 of the second embodiment may be used without the wall mounting apparatus 16 and instead used with the portable urinal storage unit 14. It is also obvious that the wall mounting apparatus 16 may be used with the first preferred embodiment of the apparatus as shown in FIG. 1 and with the third preferred embodiment as shown in FIG. 5.

What is claimed is:

1. A portable urinal apparatus, comprising:

an egg shaped hollow catch basin, which has an interior chamber, a wide side urinal opening provided on a front side, and an outlet opening provided on a bottom of said catch basin for discharging fluids in said catch basin, wherein said catch basin defines a semi enclosed interior chamber which has a size larger than an erect penis of a male user, and said urinal opening has a height and a width of at least five inches respectively so that said erect penis of said male user is able to entirely place therein, wherein the urinal opening is angled and defines a lip at a bottom of said urinal opening in such a manner that said lip extends outwardly and away from said catch basin to define a catch area adapted for allowing said catch basin to catch any flows and dripping during urination of said male user, wherein top and side walls of said catch basin are curved to reflect any fluid splattering towards an inside of said interior chamber and a bottom of said interior chamber is sloped down towards said outlet opening in bowl shape, so as to direct any liquid flowing into said interior chamber to a middle of said interior chamber rather than sides of said interior chambers to prevent splashing out;

a supporter connected to said top wall of said catch basin; and a discharge tube connecting to said bottom of said catch basin, wherein a top end of said discharge tube communicates with said outlet opening for the removal of fluids from said catch basin, through said outlet opening, to a bottom end of said discharge tube;

thereby, said male user is capable of holding said portable urinal apparatus by said supporter and placing said discharge tube over a toilet while placing said penis of said male user inside said interior chamber via said wide side urinal opening to urinate into said catch basin, so that urine flows through said catch basin down said discharge tube to said toilet.

2. A portable urinal apparatus, as recited in claim 1, further comprising a wall mounting apparatus which comprises a wall affixing mount affixedly attached to a wall and a swivel arm having one end affixedly connected to said supporter and another end pivotally connected with said wall affixing mount, wherein said swivel arm is arranged to be capable of swiveling from an closed position next to said wall to an open position for placing said portable urinal apparatus resting over a toilet.

3. A portable urinal apparatus, as recited in claim 2, wherein interior surfaces of said catch basin and said discharge tube are coated with a slick coating material.

4. A portable urinal apparatus, as recited in claim 3, wherein said discharge tube further comprises at least two sections of tubing such that a lower section is capable of retracting into an upper section for adjusting a height of said discharge tube.

5. A portable urinal apparatus, as recited in claim 2, wherein said discharge tube further comprises at least two sections of tubing such that a lower section is capable of retracting into an upper section for adjusting a height of said discharge tube.

6. A portable urinal apparatus, as recited in claim 1, further comprising a portable storage unit which comprises a base adapted to steadily stand on ground, and a holder upwardly extended from said base, wherein said holder provides a vertical holding chamber to receive a bottom portion of said discharge tube fittingly therein so as to hold said portable urinal apparatus in position when not in use.

7. A portable urinal apparatus, as recited in claim 6, wherein interior surfaces of said catch basin and said discharge tube are coated with a slick coating material.

8. A portable urinal apparatus, as recited in claim 7,wherein said discharge tube further comprises at least two sections of tubing such that a lower section is capable of retracting into an upper section for adjusting a height of said discharge tube.

9. A portable urinal apparatus, as recited in claim 6, wherein said discharge tube further comprises at least two sections of tubing such that a lower section is capable of retracting into an upper section for adjusting a height of said discharge tube.

10. A portable urinal apparatus, as recited in claim 1, wherein interior surfaces of said catch basin and said discharge tube are coated with a slick coating material.

11. A portable urinal apparatus, as recited in claim 10, wherein said discharge tube further comprises at least two sections of tubing such that a lower section is capable of retracting into an upper section for adjusting a height of said discharge tube.

12. A portable urinal apparatus, as recited in claim 1, wherein said discharge tube further comprises at least two sections of tubing such that a lower section is capable of retracting into an upper section for adjusting a height of said discharge tube.

* * * * *